US005170539A

United States Patent [19]

Lundstedt et al.

[11] Patent Number: 5,170,539

[45] Date of Patent: Dec. 15, 1992

[54] SPRING LOADED SLIDING BAR WEB CONNECTOR ASSEMBLY FOR A BUCKLE

[75] Inventors: Kurt H. Lundstedt, Long Grove; Steven C. Keller, Island Lake, both of Ill.

[73] Assignee: Illinois Tool Works Inc., Glenview, Ill.

[21] Appl. No.: 796,025

[22] Filed: Nov. 22, 1991

[51] Int. Cl.[5] ..... A44B 11/25

[52] U.S. Cl. ..... 24/196; 24/194; 24/313

[58] Field of Search ..... 24/196, 197, 198, 171, 24/182, 313, 312, 616, 606, 625, 635

[56] References Cited

U.S. PATENT DOCUMENTS

| | | | |
|---|---|---|---|
| 1,521,439 | 12/1924 | Forsell | 24/313 |
| 1,764,044 | 6/1930 | Hoffman | 24/313 |
| 3,163,905 | 1/1965 | Gaylord | 24/196 |
| 3,293,713 | 12/1966 | Gaylord | 24/196 |
| 3,402,439 | 9/1968 | Currat | 24/194 |
| 3,789,467 | 2/1974 | Aratani et al. | 24/313 |
| 4,150,464 | 4/1979 | Tracy | 24/196 |

*Primary Examiner*—Victor N. Sakran
*Attorney, Agent, or Firm*—Schwartz & Weinrieb

[57] ABSTRACT

A buckle having a sleeve portion including a receiving channel, a web connector member positioned within the channel for cooperation with the sleeve, and a spring member integrally formed with the web connector member for providing a spring bias to the web connector member with respect to the sleeve so that a web can be affixed to the buckle for adjustable cooperation with the web connector member, the sleeve and the spring member with the web connector member being accessible from the exterior of the buckle for manipulation by a user against the force of the spring member so as to adjust or remove the web.

21 Claims, 3 Drawing Sheets

SPRING LOADED SLIDING BAR WEB CONNECTOR ASSEMBLY FOR A BUCKLE

BACKGROUND OF THE INVENTION

1. Field of the Invention

The present invention relates generally to buckles, and more particularly to a buckle which is connected to a web or strap and includes a web engagement bar which is slidable with respect to the buckle, spring biased so as to engage and restrict adjustment and removal of the web, and readily accessible for manipulation by means of a user so as to adjust or remove the web.

2. Description of the Related Art

Buckles are typically utilized for releasably joining two portions or free ends of a web or strap where the buckle includes two components which can be releasably connected together in a variety of ways. Each component includes a connecting portion for affixing the free ends of the web to the buckle in an adjustable or non-adjustable manner. Buckles having one component are also employed which typically only adjust the length of a web or strap.

The adjustable connection defined between the web and the buckle component typically includes two slots formed within a portion of the buckle with a web engagement bar formed between the two slots and about which the web is threaded. The connection is such that portions of the buckle adjacent the slots clamp the web so that under normal conditions of use the web will not slip through the slots and the desired length of the web is retained or maintained. The web is adjustable upon suitable manipulation of the buckle with respect to the strap.

Another type of adjustable connection includes a web engagement bar which is slidably mounted within an aperture of a connecting portion of the buckle. These types of connections provide better holding of the web and adjustment of the web length. An example of such an adjustable sliding bar buckle is shown in U.S. Pat. No. 4,150,464 which is assigned to the assignee of the present application. Although such buckles are most effective and have exhibited great commercial success, web engagement occurs only after the web is placed in tension and adjustment of the web length can be bothersome.

In order to provide web engagement before the web is placed in tension, buckles have been provided with sliding web engagement bars which are spring biased. An example of such a buckle is shown in U.S. Pat. No. 3,163,905. That patent discloses an adjustable webbing connector or adaptor having a sleeve and a connector element which slidably fits within one end of the sleeve. A separate elongate retaining spring having a predetermined complex shape is inserted behind the connector element for engagement therewith. The free ends of the spring are flexed so as to be retained within apertures formed within the sleeve so as to provide an inward spring bias of the connector element with respect to the sleeve.

This type of web connector can be difficult to manipulate and can be unintentionally activated during use. For example since the connector is loosened and the web is shortened merely by pulling upon the free end of the web, unintentional shortening of the web and/or complete unthreading of the web can occur during normal use. Additionally, in order to lengthen the web, the entire connector member must be manipulated against the spring bias while the web is in an adjusted state within the connector which can be difficult for most users, especially if the web is in tension during adjustment. Furthermore, this type of connector has an undesirable wide profile and outwardly extending components which can become caught upon other articles during use.

It is therefore desirable to provide a buckle having a spring biased sliding web engagement bar which can be easily molded and readily assembled, has a sleek profile without any protruding elements, provides web engagement without the web being placed in tension, is easy to manipulate so as to adjust the length of the web, and restricts unintentional adjustment or unthreading of the web.

SUMMARY OF THE INVENTION

The present invention provides a buckle having a sleeve portion including a receiving channel and a web connector member positioned within the channel for cooperation with the sleeve. A spring member is also provided which is integrally formed with the web connector member for providing a spring bias to the web connector member with respect to the sleeve. A web is affixed to the buckle for adjustable cooperation with the web connector member, the sleeve and the spring member, with the web connector member being accessible from the exterior of the buckle for manipulation by means of a user against the force of the spring member so as to adjust or remove the web.

BRIEF DESCRIPTION OF THE DRAWINGS

Various objects, features, and attendant advantages of the present invention will be more fully appreciated from the following detailed description when considered in connection with the accompanying drawings, in which like reference characters designate like or corresponding parts throughout the several views, and wherein.

DETAILED DESCRIPTION OF THE PREFERRED EMBODIMENTS

Figure 1:
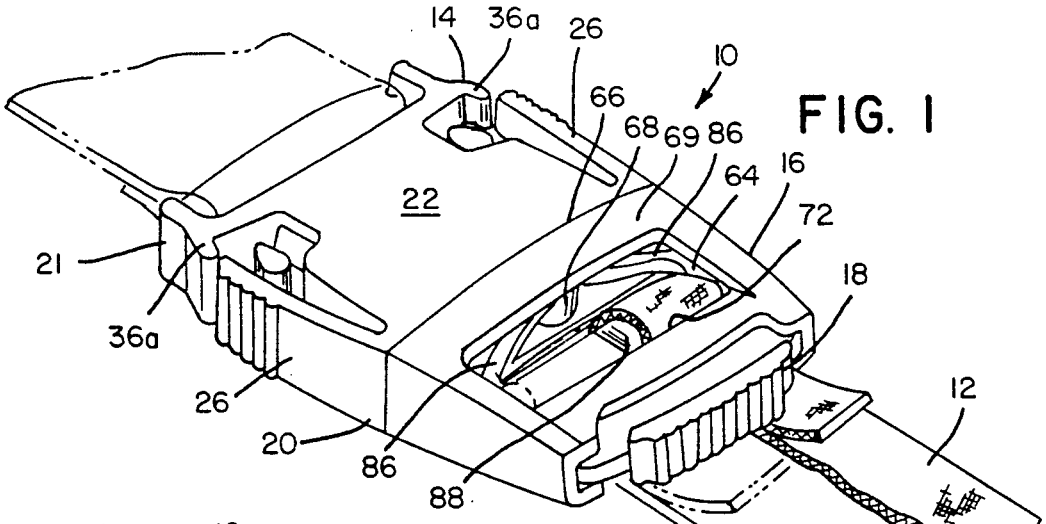
FIG. 1 is a front perspective view of an assembled buckle and adjustable connector of the present invention illustrated with a web or strap in partial section and in dotted outline threaded through the adjustable connector.
Figure 2:
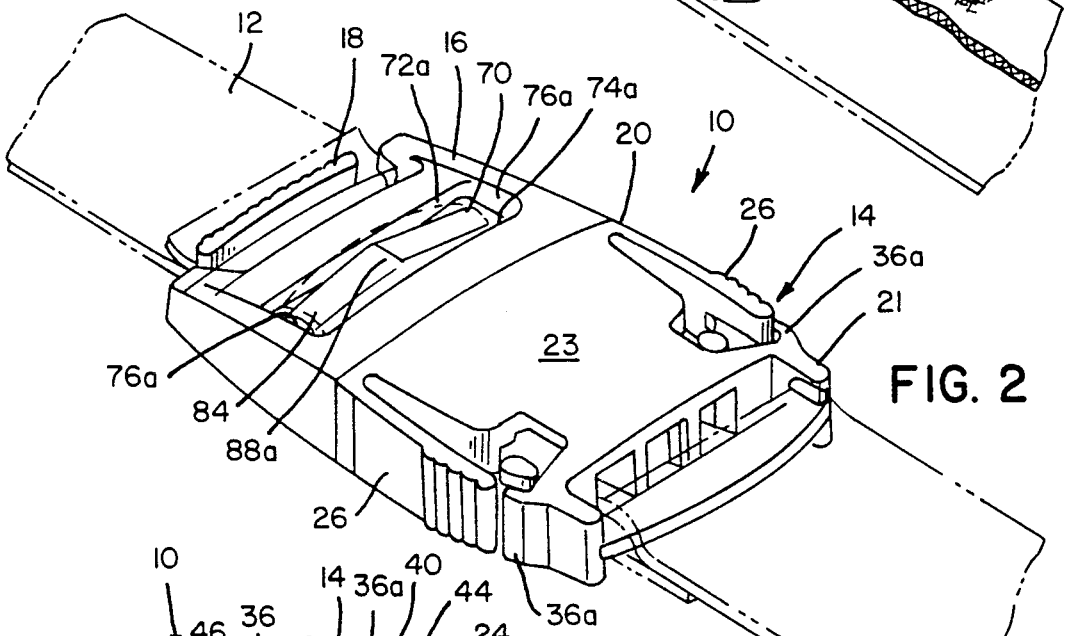
FIG. 2 is a rear perspective view of the assembled buckle and adjustable connector of FIG. 1 which is rotated 180 degrees.

Referring to FIGS. 1 and 2, the buckle and adjustable web connector assembly of the present invention is designated, generally by means of the reference numeral 10. The assembly 10 is typically utilized with a web or strap 12 and preferably only includes three separate parts: a female buckle connector member 14, a male buckle connector member 16 and a slidable web connector member 18.

The female connector member 14 and male connector member 16 form the buckle portion of t he assembly 10 and are illustrated as a side release buckle. It is to be understood, however, that the invention is applicable to a wide variety of buckles. Additionally, although the slidable web connector 18 of the assembly 10 is illustrated in conjunction with the male connector member 16, the slidable web connector 18 can also be utilized with the female connector member 14 or both the female and male connector members 14 and 16, if desired.

Figure 3:
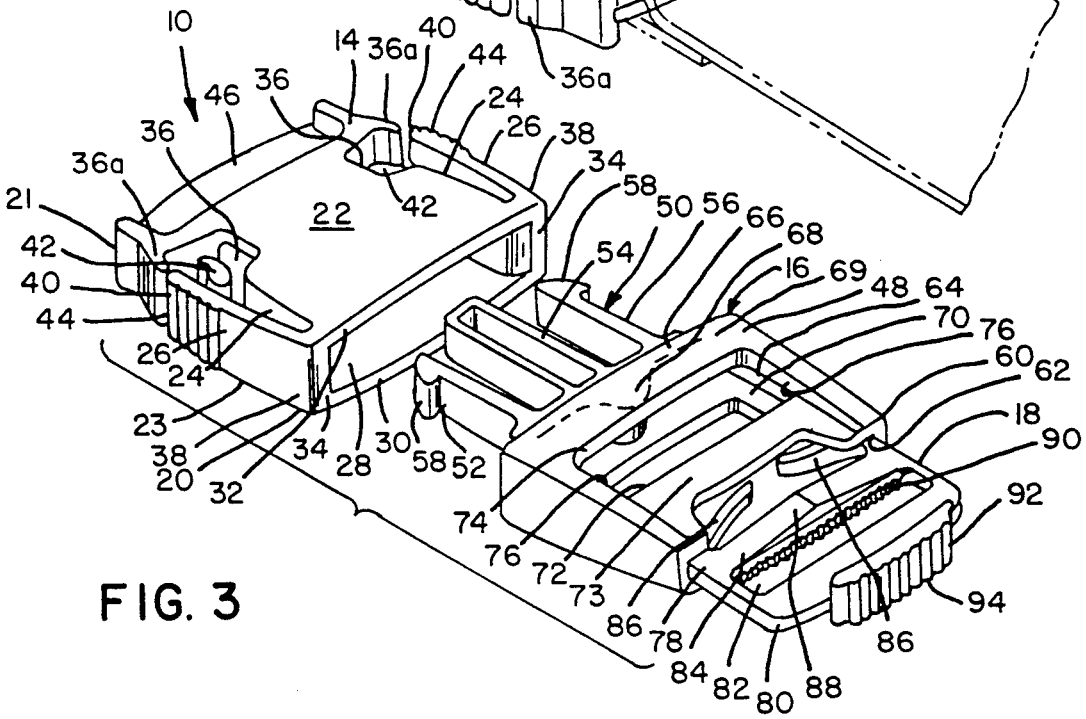
FIG. 3 is a perspective, partially exploded view of the buckle and adjustable connector of FIG. 1.

As FIG. 3 illustrates, the female connector member 14 is preferably formed from a suitable plastic material as a hollow tubular housing or sleeve having a generally rectangular cross-sectional configuration for accepting the plastic male connector member 16 therein. The particular size, shape and material of both the connector members 14 and 16, however, can vary.

The female connector member 14 includes a first male connector receiving end 20, a second web connecting end 21, an upper surface 22, a lower surface 23 and opposite sides 24, each of which includes a resilient buckle release arm 26. As will be explained in detail below, the receiving end 20 includes a hollow interior 28 which receives the male connector member 16 therein.

The hollow interior 28 is defined by means of a bottom surface 30, top surface 32 and opposite side surfaces 34. The bottom surface 30 as well as the top surface 32 can be formed with guide channels (not illustrated) for guiding the male connector member 16 into proper engagement within the hollow interior 28.

The side surfaces 34 are slightly tapered inwardly toward the hollow interior 28 and each includes an aperture 36 therethrough proximate the second web connecting end 21. The apertures 36 are located at predetermined positions so that each release arm 26 can extend through the female connector member 14 apertures 36 so as to engage a portion of the male connector member 16 and enable release of the buckle. In order to prevent over extension of the release arms 26 in an outward direction, the female connector member 14 includes safety engagement tabs 36*a* proximate the apertures 36 which function as stops against which the release arms 26 can engage.

Each resilient release arm 26 includes a first proximal end 38, which is integrally formed with the female connector 14, and a second distal end 40, which includes an engagement portion 42. In order to assist in manipulation of the distal ends 40 of the release arms 26, the exterior surface of each distal end 40 can include ribs 44.

The web connecting end 21 of the female connector 14 includes a web connector bar 46 about which a free end of the web 12 is wrapped. The web 12 is then typically connected to itself such as, for example, by means of sewing, melting or welding as well as with an adhesive or an other desired connector member.

The male connector member 16, like the female connector 14, is preferably formed from a suitable plastic material as a hollow tubular housing or sleeve having a substantially rectangular cross-sectional configuration. The male connector member 16 includes a base section 48 and a locating section 50 which extends axially outwardly from one end of the base section 48. The locating section 50 is to be inserted into the hollow interior 28 of the female connector 14 and includes three substantially parallel and laterally spaced arms 52, 54 and 56.

The intermediate arm 54 functions as a guide member for engagement within a guide channel (not illustrated) defined within the female connector member 14. The two outer arms 52 and 56 are resiliently or flexibly formed with the base section 48 for deflection toward the intermediate arm 54. Each outer arm 52 and 56 includes a latching member 58 at a distal end thereof for cooperation with the female connector member 14.

In order to connect the male connector member 16 to the female connector member 14, the arms 52, 54 and 56 of the locating section 50 of the male connector member 16 are inserted into the hollow interior 28 of the female connector member 14. During insertion, the intermediate arm 54 functions as a guide while the two outer arms 52 and 56 engage the tapered sides 34 of the hollow interior 28 and begin to defect inwardly. Upon continued insertion of the male member 16, the latch members 58 upon the arms 52 and 56 extend through and clear the apertures 36 defined within the sides 34 of the female member and snap outwardly so as to seat behind the walls defining the apertures 36 and lock the male connector member 16 to the female connector member 14.

In order to disengage the male connector member 16 from the female connector member 14, a user engages the resilient buckle release arms 26 of the female connector member 14 and deflects them inwardly. This causes engagement portions 42 of the release arms 26 to engage the latch members 58 upon the outer arms 52 and 56 of the male connector member 16. Continued deflection forces the latch members 58 inwardly thereby clearing the walls defining the apertures 36 and enabling the male connector member 16 to be removed from the female connector member 14.

As FIG. 3 illustrates, the base section 48 of the male connector member 16 includes a receiving end 60 disposed opposite the locating section 50. The receiving end 60 includes a slotted aperture 62 in communication with a complementary channel 64 which extends through the base section 48 for receiving the slidable web connector member 18 therein.

Figure 4:
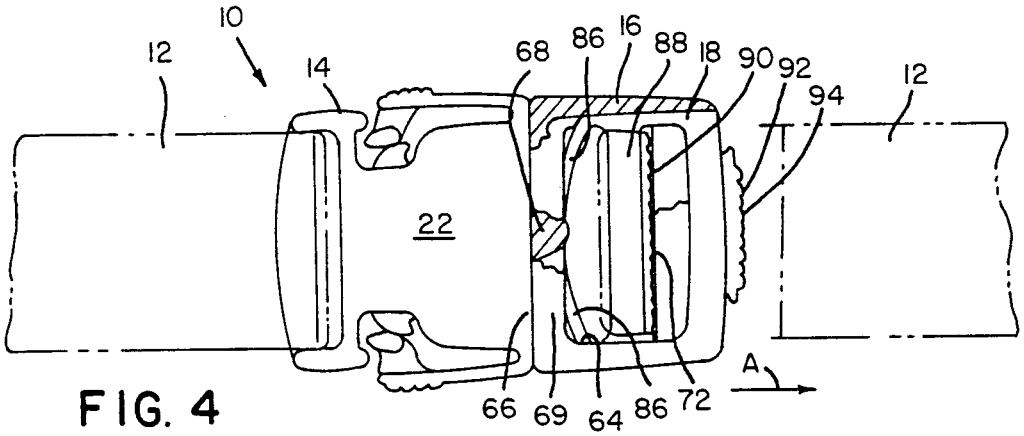
FIG. 4 is a plan view in partial section of the assembled buckle and adjustable connector of FIG. 1.

The channel 64 is dimensioned to cooperate with the external dimensions of the connector member 18 and assist in guiding and seating of the connector member 18 therein. As FIGS. 3 and 4 illustrate, a closed end 66 of the channel 64 includes a protruding cam surface 68 proximate its lateral midpoint. The cam surface 68 assists in guiding a portion of the connector member 18 as will be described below. In order to further assist in guiding and to enclose the leading end of the connector member 18, the closed end 66 of channel 64 also may include a cover portion 69, one each upon opposite upper and lower sides of the channel 64.

As FIG. 3 illustrates, the male connector member 16 also includes a first aperture or through-bore 70 of a substantially rectangular configuration through which the web 12 is passed. The through-bore 70 is positioned substantially transverse to the channel 64 and is defined upon the upper surface of the assembly 10 by means of a first elongate wall portion 72 formed by means of a cross-member 73, an opposite elongate wall portion 74 and a pair of opposite side walls 76 which are shorter than the wall portions 72 and 74.

As FIG. 2 illustrates, due to the tubular shape of the male connector member 16, the through-bore 70 is defined upon the lower surface of the assembly 10 by means of similar wall members 72*a*, 74*a* and 76*a*. In order to assist in gripping the web 12, the first wall portion 72 and/or 72*a* can include teeth (not illustrated).

As FIG. 3 illustrates, the slidable web connector member 18 is substantially rectangular in shape and dimensioned so as to fit snugly within the channel 64 of the male connector member 16. The connector member 18 includes a first end 78, a second end 80, a through aperture 82 and a web connector bar 84.

In order to provide a spring bias to the connector member 18 with respect to the male connector member 16 after insertion therein, the first end 78 includes two resilient legs 86 extending outwardly therefrom a predetermined distance. As FIGS. 1, 3 and 4 illustrate, these legs 86 engage the cam 68 of the closed end 66 of the channel 64. When the connector member 18 is fully seated within the channel 64, the cam 68 as well as the cover portions 69 guide the legs 86 and prevent the legs 86 from binding without inhibiting the desired spring action. The cover portions 69 also substantially hide the legs 86 and inhibit any outside elements from engaging the legs 86 and restricting their desired movement.

In order to secure the connector member 18 within the channel 64 against the force of the spring bias provided by means of the legs 86, the web connector bar 84 of the connector member 18 includes an arched or raised portion 88 proximate its lateral midpoint. In order to assist in insertion, the arched portion 88 is preferably tapered from the first end 78 toward the second end 80 of the connector member 18.

As FIG. 1 illustrates, after the connector member 18 is fully seated within the channel 64, the arched portion 88 engages the first portion 72 of the through-bore 70 so as to restrict removal of the member 18 from the member 16. In order to insert or move the arched portion 88 past the cross-member 73 of the male connector member 16 which defines the first portion 72, the connector member 18 is provided with increased insertion pressure so as to enable the tapered arched portion 88 to gradually flex the cross-member 73 outwardly.

It is to be noted that, as FIG. 2 illustrates, the web connector bar 84 of the connector member 18 can include a second arched portion 88*a* on its lower side opposite the arched portion 88 for similar engagement with the portion 72*a* of the through-bore 70 upon the lower side of the male connector. Additionally, the arched portions 88 and 88*a* can be replaced with any similar member so long as it can be inserted so as to engage the portions 72 and 72*a* and retain the connector portion 18 within the channel 64 against the spring bias as desired.

Figure 5:
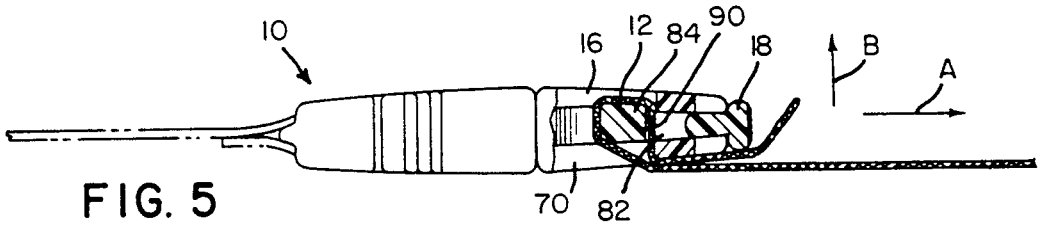
FIG. 5 is a side elevational view in partial section of the assembled buckle and adjustable connector of FIG. 4.

When the connector member 18 is fully inserted within the channel 64 and sufficient pressure is provided so as to deflect the legs 86, the aperture 82 of the connector member 18 is in alignment with the through-bore 70 of the male connector member 16. The web 12 can then be inserted, as FIG. 5 illustrates, through the through-bore 70, about the web connector bar 84, through the aperture 82, and back out of the through-bore 70 so as to be adjusted to a desired length as will be described in detail below.

Upon release of the connector member 18, the spring bias of the legs 86 forces the web connector bar 84 to the right with respect to FIG. 4 in the direction of arrow "A" until the arched portion 88 engages the first portion 72 of the through-bore 70 with the web 12, illustrated in dotted outline, captured therebetween. In order to assist in gripping the web 12, the side of the web connector bar 84 facing the first portion 72 of the through-bore 70 can include teeth 90.

As FIGS. 3 and 4 illustrate, in order to assist in the manipulation of the connector member 18 within the channel 64 against the spring bias, the second end 80 of the connector member 18 can be formed with a push button 92 which can include ribs 94.

As FIG. 3 illustrates, in order to assemble the connector member 18 within the male connector member 16, the first end 78 of the connector member 18 is inserted into the channel 64 of the member 16. Upon continued insertion and with a slight amount of pressure, the tapered arched portion 88 first flexes the cross member 73 upwardly and then clears the cross member 73 so as to become seated behind it. In this position, illustrated in FIG. 1, the legs 86 are slightly depressed so as to provide the desired spring bias whereby the arched portion 88 is seated against the first portion 72 of the through-bore 70 so as to restrict outward movement of the connector member 18 from the member 16 in accordance with the spring bias.

In order to connect the web 12 to the assembly 10, the push button 92 is depressed axially inwardly so as to align the aperture 82 of the connector member 18 with the through-bore 70 of the male connector member 16. A free end of the web 12 is then inserted through the through-bore 70, into the space defined between the legs 86 and the connector bar 84, about the web connector bar 84, through the aperture 82, and back out of the through-bore 70. The push button 92 can then be released, whereby the legs 86 move the connector member 18 in the direction of arrow "A" of FIG. 4 so that the arched portion 88 engages the first portion 72 of the through-bore 70 with the web 12 secured therebetween.

Adjusting or removing the web 12 can be accomplished in one of two ways. First, the push button 92 can be depressed axially inwardly so as to compress the legs 86, move the connector member 18 in the direction opposite to that of arrow "A" of FIG. 4, and align the aperture 82 with the through-bore 70. Thereafter, the web 12 can be readily adjusted or removed as desired.

It is to be noted that when adjusting the web 12 by depressing the push button 92 axially inwardly adjustment is accomplished in accordance with a mode of operation which is referred to as a "low release angle." A release angle typically refers to the angle between one of the webs 12 and the plane of the buckle. For example, in FIG. 5 the release angle between either one of the webs 12 and the plane of the buckle is relatively small or low and is close to zero. With the vast majority of buckles, however, adjustment of the web 12 is not possible in accordance with such a low release angle since the cooperation between the web connector bar and the gripping components of the buckle prevent any movement of the web 12 while it is in tension. Upon depression of the push button 92, however, the web 12 can be adjusted merely by pulling one lead of the web even when the same is disposed at such a low release angle.

Alternatively, the assembly 10 can be tilted so as to be aligned with the direction of arrow "B" which is illustrated in FIG. 5 with respect to the direction of pull or tension of the web 12, which typically is in the direction of arrow "A". This tilting operation increases the release angle. After tilting the assembly 10 a sufficient amount in accordance with the direction of arrow "B", which can be less than 90°, one lead of the web 12 then can be pulled in the direction of arrow "A" so as to adjust its length. The web 12 can also be removed in this manner, provided the free end of the web 12 is substantially flat. This type of adjustment is dependent upon the release angle, the amount of spring force provided by means of the legs 86, and the cooperation between the web connector member 18 and male connector member 16.

Figure 8:
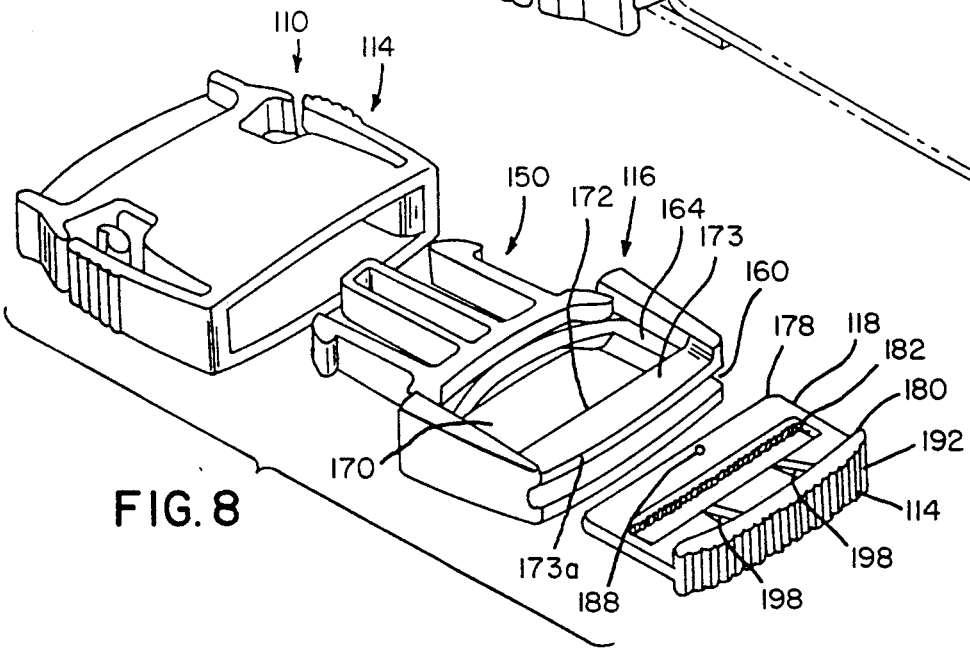
FIG. 8 is a perspective exploded view of the buckle and adjustable connector of FIG. 6.

FIGS. 6–10 illustrate an alternate embodiment of the present invention and comprises an assembly 110 where common elements are referred to by the same reference numerals. As FIG. 8 illustrates, in this embodiment of the assembly 110, the female buckle connector member 114 and the locating section 150 of the male connector member 116 are substantially the same as the corresponding elements in the embodiment of FIGS. 1–5. Modifications are provided in the embodiment of FIGS. 6–10 with respect to the channel 164 of the receiving end 160 of the male connector member 116 as well as the structure of the slidable web connector member 118 but such modified structures accomplish substantially the same results as in the structural component of the embodiment of FIGS. 1–5.

Figure 9:
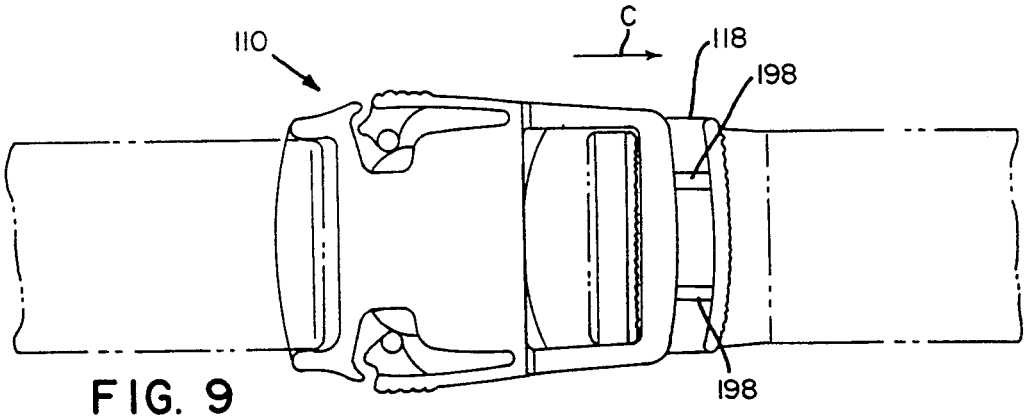
FIG. 9 is a plan view of the assembled buckle and adjustable connector of FIG. 6.
Figure 6:
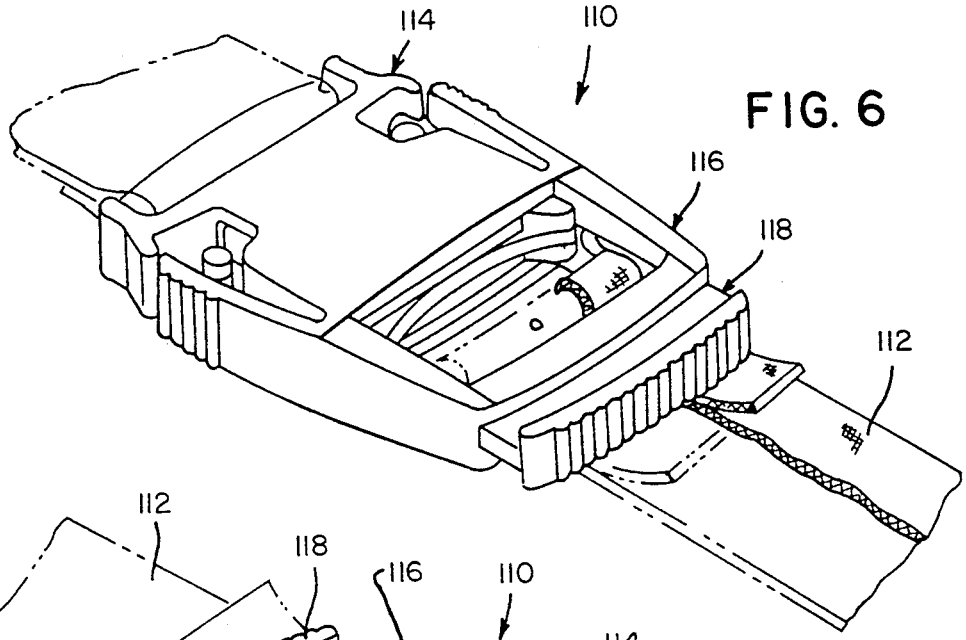
FIG. 6 is a front perspective view of an assembled buckle and adjustable connector, similar to FIG. 1, but illustrating another embodiment of the invention.
Figure 7:
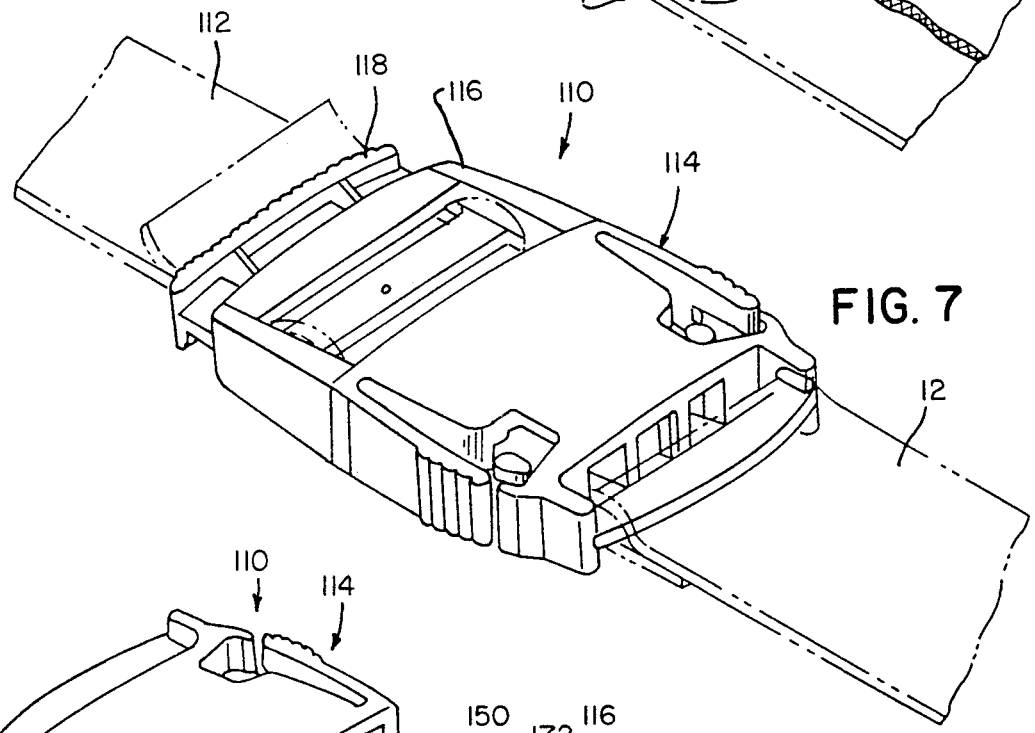
FIG. 7 is a rear perspective view of the assembled buckle and adjustable connector of FIG. 6 which is rotated 180 degrees.

As FIGS. 6, 8 and 9 illustrate, within the male connector member 116, the raised cam 68 and cover portions 69 have been eliminated from the channel 164. Additionally, the central portion of the cross member 173 extends outwardly to the end of the receiving end 160 of the male connector member 116. It may also be necessary to slightly modify the dimensions of the channel 164 so as to complement the exterior dimensions of the slidable web connector member 118.

The legs 86 are eliminated from the leading end 178 of the connector member 118. Additionally, the arched portions 88 and 88*a* are replaced with one or more detents or nibs 188 which can be tapered if desired. As will be explained below, the detents 188, like the arched portions 88 and 88*a*, prevent removal of the connector member 118 from the channel 164 of the member 16 against the desired spring force.

Figure 10:
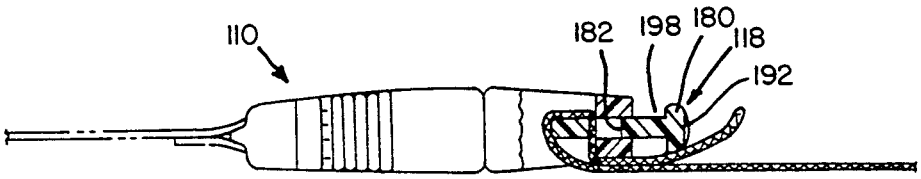
FIG. 10 is a side elevational view in partial section of the assembled buckle and adjustable connector of FIG. 9.

As FIGS. 8 and 10 illustrate, in order to provide such spring force, the second end 180 of the connector member 118, proximate the push button 192, includes two ramps or cammed surfaces 198. The ramps 198 are tapered from a low end proximate the aperture 182 to a high end proximate the push button 192. Thus, the spring bias is provided in the direction of arrow "C" as seen in FIG. 9 by means of the cooperation between the ramps 198 and an exterior edge 173*a* of the cross member 173 which is opposite the first portion 172 of the through-bore 170.

As FIG. 8 illustrates, in order to assemble the connector portion 118 to the male connector member 116, the first end 178 of the connector portion 118 is inserted within the channel 164 until the tapered detent 188 engages the, cross member 173. Upon continued insertion of the member 118 in member 116, the detent 188 flexes the cross member 173 slightly outwardly until it clears the cross member 173 and is seated behind it.

At this position, the ramps 198 are in contact with the cross member 173 and, due to the resiliency of the cross member 173, the spring bias is impressed upon the connector member 118 as seen in the direction of arrow "C" in FIG. 9. Upon depression of the push button 192, the ramps 198 exert further pressure upon the cross member 173 so as to further increase the spring force.

In order to attach a web 12 to the connector member 118, the push button 192 is depressed until the aperture 182 of the connector member 118 is aligned with the through-bore 170 of the male connector member 116. The web 12 is then threaded about the connector member 118 as in the embodiment of FIGS. 1–5. Upon release of the push button 192, the spring bias provided by means of the cross member 173 and ramps 198 inhibits adjustment and/or removal of the web 12. It is to be noted that the web 12 may also be adjusted by increasing the high release angle as in the embodiment of FIGS. 1–5.

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A buckle, comprising:

a sleeve portion including a channel receiving means for accepting a member therein;

a web connector member positioned within said channel receiving means for cooperation with said sleeve portion; and spring means integrally formed with said web connector member for providing a spring bias to said web connector member with respect to said sleeve portion so that a web can be affixed to said buckle for adjustable cooperation with said web connector member, said sleeve portion, and said spring means, said web connector member being accessible from a position exterior to said buckle for manipulation by means of a user against said bias of said spring means so as to adjust or remove said web, said sleeve portion including a first aperture defined therethrough, and said web connector member including a second aperture defined therethrough for alignment with said first aperture of said sleeve portion upon compression of said spring means.

2. The buckle as defined in claim 1 wherein said spring means include at least one resilient leg member extending from said web connector member for engagement with said sleeve portion and providing the desired spring bias.

3. The buckle as defined in claim 1 wherein said spring means include at least one ramp member formed with said web connector member for engagement with a portion of said channel receiving means of said sleeve portion and providing the desired spring bias.

4. The buckle as defined in claim 1 wherein said web connector member includes push button means formed integrally therewith and accessible from the exterior of said sleeve portion for manipulation of said web connector member against said spring means and providing for adjustment or removal of the web.

5. A buckle as set forth in claim 1, wherein:

said web connector member includes a transversely extending bar portion, defining in part said second aperture extending therethrough, about which said web is wrapped and which cooperates with said sleeve portion for adjustably securing said web within said buckle.

6. A buckle, comprising:

a sleeve portion including a first aperture therethrough and channel receiving means for accepting a member therein, said channel receiving means being formed substantially perpendicular to said first aperture;

a web connector member positioned for sliding engagement within said channel receiving means, said web connector member including a second aperture therethrough for alignment with said first aperture of said sleeve portion; and spring means integrally formed with said web connector member for biasing said web connector member with respect to said sleeve portion, so that a web can be affixed to said buckle for adjustable cooperation with said web connector member, said sleeve portion and said spring means, with said web connector member being accessible from the exterior of said buckle for manipulation by a user against said spring means to adjust or remove the web.

7. The buckle as defined in claim 6 wherein said spring means include at least one resilient leg member extending from said web connector member for engagement with said sleeve portion and providing the desired spring bias.

8. The buckle as defined in claim 6 wherein said spring means include at least two resilient leg members extending from said web connector member for engagement with a wall portion formed within said channel receiving means of said sleeve, said wall portion including a recess formed therein for receiving said leg portions and including a cam member formed proximate the midpoint of said recess for deflection and guiding of said leg members in a desired direction upon compression of said leg members.

9. The buckle as defined in claim 6 wherein said web connector member includes push button means formed integrally therewith and accessible from the exterior of said sleeve portion for manipulation of said web connector member with respect to said sleeve portion and against the force of said spring means to provide for adjustment or removal of the web.

10. The buckle as defined in claim 6 including means for retaining said web connector member within said sleeve portion against said spring bias.

11. The buckle as defined in claim 10 wherein said means for retaining include an arched portion positioned along a portion of said web connector member and upstanding therefrom for abutting engagement with said sleeve portion.

12. The buckle as defined in claim 10 wherein said means for retaining include a detent member positioned along a portion of said web connector member and upstanding therefrom for abutting engagement with said sleeve portion.

13. The buckle as defined in claim 6 wherein a portion of said second aperture of said web connector member includes one or more teeth to assist in gripping the web which can be threaded therethrough.

14. The buckle as defined in claim 6 wherein said spring means include at least one ramp member formed with said web connector member for engagement with a portion of said channel receiving means of said sleeve portion and providing the desired spring bias.

15. The buckle as defined in claim 6 wherein said spring means include at least two ramp members positioned on said web connector member for engagement with a portion of said channel receiving means of said sleeve portion, said ramp members cooperating with said sleeve portion to provide the desired spring bias.

16. A buckle as set forth in claim 6, wherein:

said web connector member includes a transversely extending bar portion, defining in part said second aperture extending therethrough, about which said web is wrapped and which cooperates with said sleeve portion for adjustably securing said web within said buckle.

17. A buckle, comprising:

a sleeve portion including an open end through which a member can be inserted, channel receiving means for housing said member therein, and an end wall disposed opposite said open end;

a web connector member positioned within said channel receiving means for cooperation with said sleeve portion;

spring means integrally formed with said web connector member for engaging said end wall of said sleeve portion so as to provide a spring bias to said web connector member with respect to said sleeve portion so that a web can be affixed to said buckle as a result of adjustable cooperation defined between said web connector member and said sleeve portion, said web connector member being accessible from a position external to said buckle for manipulation by means of a user against said spring bias so as to adjust or remove said web; and means defined between said sleeve portion and said web connector member for retaining said web connector member within said channel receiving means of said sleeve portion against said spring bias.

18. A buckle as set forth in claim 16, wherein:

said end wall comprises a cam member disposed at a laterally central position of said end wall; and said spring means comprises a pair of resilient leg means for engaging opposite lateral sides of said cam member for laterally stabilizing said web connector member with respect to said sleeve portion while said web connector member is disposed within said channel receiving means of said sleeve portion under the influence of said spring bias.

19. A buckle, comprising:

a sleeve portion including an open end through which a member can be inserted, and channel receiving means for housing said member therein, said open end of said sleeve portion being defined in part by means of a flexibly resilient cross-member extending transversely across said sleeve portion and interconnecting opposite sides of said channel receiving means;

a web connector member positioned within said channel receiving means for cooperation with said sleeve portion;

spring means interposed between said web connector member and said sleeve portion so as to provide a spring bias to said web connector member with respect to said sleeve portion so that a web can be affixed to said buckle as a result of adjustable cooperation defined between said web connector member and said sleeve portion, said web connector member being accessible from a position external to said buckle for manipulation by means of a user against said spring bias so as to adjust or remove said web; and upstanding means defined upon said web connector for engaging said flexibly resilient cross-member of said sleeve portion upon insertion of said web connector member through said open end and into said channel receiving means of said sleeve portion so as to flexibly and resiliently deform said cross-member of said sleeve portion and thereby permit said web connector member to be inserted into said channel receiving means of said sleeve portion, and for engaging said flexibly resilient cross-member of said sleeve portion, once said web connector member has been fully inserted within said channel receiving means of said sleeve portion and said flexibly resilient cross-member of said sleeve portion has returned to its normal undeformed position, so as to retain said web connector member within said channel receiving means of said sleeve portion against said spring bias.

20. A buckle as set forth in claim 19, wherein:

said upstanding means comprises a laterally central arched portion formed upon said web connector member.

21. A buckle as set forth in claim 19, wherein:

said upstanding means comprises a detent located upon a laterally central portion of said web connector member.

* * * * *

US005170539C1

(12) EX PARTE REEXAMINATION CERTIFICATE (7018th)

United States Patent
Lundstedt et al.

(10) Number: US 5,170,539 C1
(45) Certificate Issued: Aug. 25, 2009

(54) SPRING LOADED SLIDING BAR WEB CONNECTOR ASSEMBLY FOR A BUCKLE

(75) Inventors: Kurt H. Lundstedt, Long Grove, IL (US); Seven C. Keller, Island Lake, IL (US)

(73) Assignee: Illinois Tool Works Inc., Glenview, IL (US)

Reexamination Request:
No. 90/008,564, Mar. 30, 2007

Reexamination Certificate for:

| | |
|---|---|
| Patent No.: | **5,170,539** |
| Issued: | **Dec. 15, 1992** |
| Appl. No.: | **07/796,025** |
| Filed: | **Nov. 22, 1991** |

(51) Int. Cl.

| | |
|---|---|
| ***A44B 11/00*** | (2006.01) |
| ***A44B 11/26*** | (2006.01) |
| ***A44B 11/25*** | (2006.01) |

(52) U.S. Cl. ..... 24/196; 24/194; 24/313

(58) Field of Classification Search ..... None
See application file for complete search history.

(56) References Cited

U.S. PATENT DOCUMENTS

| | | | |
|---|---|---|---|
| 1,764,044 | A | 6/1930 | Hoffman |
| 3,163,905 | A | 1/1965 | Gaylord |
| 3,928,895 | A | 12/1975 | Klink |
| 4,131,976 | A | 1/1979 | Bengtsson |

*Primary Examiner*—Peter C. English

(57) ABSTRACT

A buckle having a sleeve portion including a receiving channel, a web connector member positioned within the channel for cooperation with the sleeve, and a spring member integrally formed with the web connector member for providing a spring bias to the web connector member with respect to the sleeve so that a web can be affixed to the buckle for adjustable cooperation with the web connector member, the sleeve and the spring member with the web connector member being accessible from the exterior of the buckle for manipulation by a user against the force of the spring member so as to adjust or remove the web.

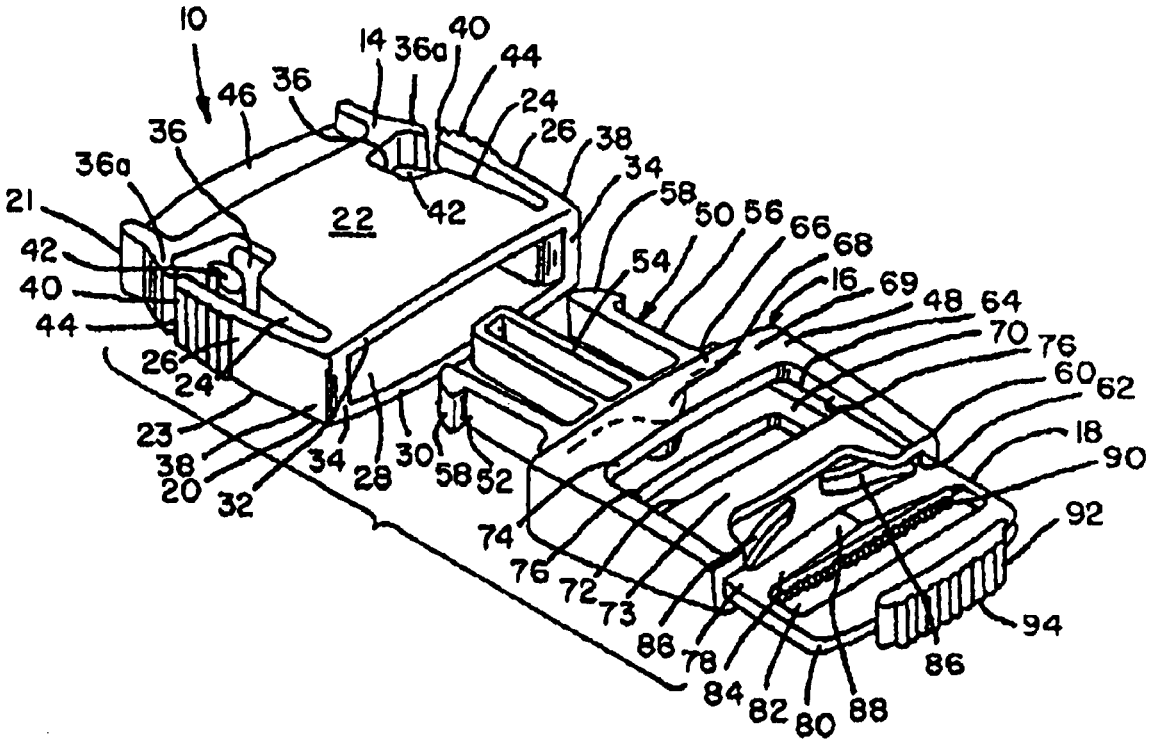

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 24–30:

As FIG. 3 illustrates, the female connector member 14 is preferably formed from a suitable plastic material as a hollow tubular housing or sleeve having a generally rectangular cross-sectional configuration for accepting the plastic male connector member 16 therein. The particular size, shape, and material of both the connector members 14 and 16, however, can vary. *Web connector 18 is also fabricated from a suitable plastic material as can be seen in FIG. 5 by means of the cross-hatching thereof.*

AS A RESULT OF REEXAMINATION, IT HAS BEEN DETERMINED THAT:

Claims 2, 3, 7, 14 and 15 are cancelled.

Claims 1, 4, 6, 8, 9, 11, 12 and 17–19 are determined to be patentable as amended.

Claims 5, 10, 13, 16, 20 and 21, dependent on an amended claim, are determined to be patentable.

1. A buckle, comprising:

a sleeve portion, *fabricated from a plastic material,* including a channel receiving means for accepting a member therein;

a web connector member, *fabricated from a plastic material,* positioned within said channel receiving means for cooperation with said sleeve portion; and

*a pair of* spring [means integrally formed] *members formed as integral members along* with said web connector member *from said plastic material comprising said web connector member and extending into said sleeve portion from laterally opposite side portions of said web connector member* for providing a spring bias to said web connector member with respect to said sleeve portion so that a web can be affixed to said buckle for adjustable cooperation with said web connector member, said sleeve portion, and said *pair of* spring [means] *members*, said web connector member being accessible from a position exterior to said buckle for manipulation by means of a user against said bias of said *pair of* spring [means] *members* so as to adjust or remove said web, said sleeve portion including a first aperture defined therethrough, and said web connector member including a second aperture defined therethrough for alignment with said first aperture of said sleeve portion upon compression of said *pair of* spring [means] *members*.

4. The buckle as defined in claim 1 wherein said web connector member includes push button means formed integrally therewith and accessible from the exterior of said sleeve portion for manipulation of said web connector member against said *pair of* spring [means] *members* and [providing] *to provide* for adjustment or removal of the web.

6. A buckle, comprising:

a sleeve portion, *fabricated from a plastic material and* including a first aperture therethrough and *a* channel receiving means for accepting a member therein, said channel receiving means being formed substantially perpendicular to said first aperture;

a web connector member, *fabricated from a plastic material,* positioned for sliding engagement within said channel receiving means, said web connector member including a second aperture therethrough for alignment with said first aperture of said sleeve portion; and

*a pair of* spring [means integrally formed] *members formed as integral members along* with said web connector member *from said plastic material comprising said web connector member and extending into said sleeve portion from laterally opposite side portions of said web connector member* for biasing said web connector member with respect to said sleeve portion, so that a web can be affixed to said buckle for adjustable cooperation with said web connector member, said sleeve portion, and said *pair of* spring [means, with] *members, wherein* said web connector member [being] *is* accessible from the exterior of said buckle for manipulation by a user against said *pair of* spring [means] *members so as* to adjust or remove the web.

8. The buckle as defined in claim 6 wherein said *pair of* spring [means include at least two resilient leg] members [extending] *extend* from said web connector member for engagement with a wall portion formed within said channel receiving means of said sleeve *portion*, said wall portion including a recess formed therein for receiving [said] leg portions *of said pair of spring members* and including a cam member formed proximate the midpoint of said recess for deflection and guiding of said leg *portions of said spring* members in a desired direction upon compression of said leg *portions of said spring* members.

9. The buckle as defined in claim 6 wherein said web connector member includes push button means formed integrally therewith and accessible from the exterior of said sleeve portion for manipulation of said web connector member with respect to said sleeve portion and against the force of said *pair of* spring [means] *members so as* to provide for adjustment or removal of the web.

11. The buckle as defined in claim 10 wherein said means for retaining *said web connector member within said sleeve portion against said spring bias* include an arched portion positioned along a portion of said web connector member and upstanding therefrom for abutting engagement with said sleeve portion.

12. The buckle as defined in claim 10 wherein said means for retaining *said web connector member within said sleeve portion against said spring bias* include a detent member positioned along a portion of said web connector member and upstanding therefrom for abutting engagement with said sleeve portion.

17. A buckle, comprising:

a sleeve portion, *fabricated from a plastic material,* including an open end through which a member can be inserted, *a* channel receiving means for housing said member therein, and an end wall disposed opposite said open end;

a web connector member, *fabricated from a plastic material,* positioned within said channel receiving means for cooperation with said sleeve portion; and

*a pair of* spring [means integrally formed] *members formed as integral members along* with said web connector member *from said plastic material comprising said web connector member and extending into said sleeve portion from laterally opposite side portions of said web connector member* for engaging said end wall of said sleeve portion so as to provide a spring bias to said web connector member with respect to said sleeve portion so that a web can be affixed to said buckle as a result of adjustable cooperation defined between said web connector member and said sleeve portion, said web connector member *also* being accessible from a position external to said buckle for manipulation by means of a user against said spring bias so as to adjust or remove said web; and means defined between said sleeve portion and said web connector member for retaining said web connector member within said channel receiving means of said sleeve portion against said spring bias.

18. A buckle as set forth in claim [16] *17*, wherein:

said end wall comprises a cam member disposed at a laterally central position of said end wall; and said *pair of* spring [means comprises] *members comprise* a pair of resilient leg [means] *portions* for engaging opposite lateral sides of said cam member for laterally stabilizing said web connector member with respect to said sleeve portion while said web connector member is disposed within said channel receiving means of said sleeve portion under the influence of said spring bias.

19. A buckle, comprising:

a sleeve portion, *fabricated from a plastic material,* including an open end through which a member can be inserted, and channel receiving means for housing said member therein, said open end of said sleeve portion being defined in part by means of a flexibly resilient cross-member extending transversely across said sleeve portion and interconnecting opposite sides of said channel receiving means;

a web connector member, *fabricated from a plastic material,* positioned within said channel receiving means for cooperation with said sleeve portion;

*a pair of* spring [means] *members formed as integral members along with said web connector member from said plastic material comprising said web connector member and extending into said sleeve portion from laterally opposite side portions of said web connector member so as to be* interposed between said web connector member and said sleeve portion [so as to] *and thereby* provide a spring bias to said web connector member with respect to said sleeve portion so that a web can be affixed to said buckle as a result of adjustable cooperation defined between said web connector member and said sleeve portion, said web connector member being accessible from a position external to said buckle for manipulation by means of a user against said spring bias so as to adjust or remove said web; and upstanding means defined upon said web connector *member* for engaging said flexibly resilient cross-member of said sleeve portion upon insertion of said web connector member through said open end and into said channel receiving means of said sleeve portion so as to flexibly and resiliently deform said cross-member of said sleeve portion and thereby permit said web connector member to be inserted into said channel receiving means of said sleeve portion, and for engaging said flexibly resilient cross-member of said sleeve portion, once said web connector member has been fully inserted within said channel receiving means of said sleeve portion and said flexibly resilient cross-member of said sleeve portion has returned to its normal undeformed position, so as to retain said web connector member within said channel receiving means of said sleeve portion against said spring bias.

* * * * *